US009561597B2

(12) United States Patent
Endo et al.

(10) Patent No.: US 9,561,597 B2
(45) Date of Patent: Feb. 7, 2017

(54) CARD-CUTTING APPARATUS

(71) Applicants: UCHIDA YOKO CO., LTD., Tokyo (JP); SAKURA SEIKI CO., LTD., Yao-shi (JP); UCHIDA YOKO GLOBAL LIMITED, Wanchai (HK)

(72) Inventors: Toshimasa Endo, Tokyo (JP); Ippei Muramoto, Yao (JP)

(73) Assignees: UCHIDA YOKO CO., LTD., Tokyo (JP); SAKURA SEIKI CO., LTD., Yao-shi (JP); UCHIDA YOKO GLOBAL LIMITED, Wanchai, Hong Kong (CN)

( * ) Notice: Subject to any disclaimer, the term of this patent is extended or adjusted under 35 U.S.C. 154(b) by 110 days.

(21) Appl. No.: 14/589,130

(22) Filed: Jan. 5, 2015

(65) Prior Publication Data

US 2015/0273720 A1 Oct. 1, 2015

(30) Foreign Application Priority Data

Mar. 31, 2014 (JP) ..... 2014-73347

(51) Int. Cl.
*B26D 7/26* (2006.01)
*B26D 1/24* (2006.01)
*B26D 11/00* (2006.01)

(52) U.S. Cl.
CPC ..... *B26D 7/2635* (2013.01); *B26D 1/245* (2013.01); *B26D 2011/005* (2013.01); *Y10T 83/6585* (2015.04); *Y10T 83/6588* (2015.04)

(58) Field of Classification Search
CPC ..... Y10T 83/768; Y10T 83/6585; Y10T 83/6588; Y10T 83/6587; Y10T 83/659; Y10T 83/6584; Y10T 83/7822; Y10T 83/7826;Y10T 83/783; Y10T 83/869; Y10T 83/8727; Y10T 83/873; Y10T 83/2092; B26D 2007/0018; B26D 2007/0068; B26D 7/2635; B26D 7/0006; B26D 7/18; B26D 1/245; B26D 1/14; B26D 1/141; B26D 1/143; B26D 1/24; B26D 11/00; B26D 2011/005
See application file for complete search history.

(56) References Cited

U.S. PATENT DOCUMENTS 393,535 A * 11/1888 Browne ..... B26D 7/2635 83/499
2,788,852 A * 4/1957 Sharpe ..... B65H 35/002 225/24

(Continued)

FOREIGN PATENT DOCUMENTS

JP 2013-144322 A1 7/2013

*Primary Examiner* — Phong Nguyen
(74) *Attorney, Agent, or Firm* — Kratz, Quintos & Hanson, LLP

(57) ABSTRACT

A card-cutting apparatus, provided with a lateral cutter portion to cut paper in a lateral direction at right angles with a transferring direction and plural slitter heads to cut the paper in the transferring direction, to conduct divisional cutting of the paper into plural cards in which the plural slitter heads are disposed in a row along a guiding rod set in the lateral direction as to be freely position-adjusted in lateral direction by manual work, a gauge plate, for positioning of the plural slitter heads on predetermined positions in the lateral direction as to cut the paper with a predetermined card cutting lateral dimension, is provided, and the gauge plate is selected from plural kinds having different card cutting lateral dimensions to be used.

3 Claims, 14 Drawing Sheets

(56) References Cited

U.S. PATENT DOCUMENTS

| | | | | |
|---|---|---|---|---|
| 3,296,911 | A * | 1/1967 | McLane | B26D 1/151<br>83/118 |
| 5,894,978 | A * | 4/1999 | Welch | B26D 1/035<br>225/18 |
| 2011/0036219 | A1* | 2/2011 | Finnell | B26D 1/18<br>83/13 |

* cited by examiner

CARD-CUTTING APPARATUS

FIELD OF THE INVENTION

This invention relates to a card-cutting apparatus.

DESCRIPTION OF THE RELATED ART

A conventional card-cutting apparatus, provided with plural middle slitter heads to cut lateral middle portions of paper and plural side edge slitter heads to cut left and right side edge portions of the paper, in which the plural middle slitter heads and the plural side edge slitter heads are disposed on different positions in paper transfer direction, electrically conducts positioning in lateral direction (refer to Japanese Patent Provisional Publication No. 2013-144322, for example).

However, a driving motor, a control equipment, sensors, screw shafts, etc. are necessary for the electric positioning of the slitter heads. This makes the whole apparatus heavy and large, much labor and time are required for the production, expensive parts and devices are necessary, and the apparatus can't be easily and economically produced.

Therefore, it is an object of the present invention to provide a card-cutting apparatus, with which the positioning of the plural slitter heads in lateral direction can be conducted easily and swiftly with accuracy by manual work as to correspond to the size of cards to be made.

BRIEF DESCRIPTION OF THE DRAWINGS

The present invention will be described with reference to the accompanying drawings, in which.

DESCRIPTION OF THE PREFERRED EMBODIMENTS

Preferred embodiments of the present invention will now be described with reference to the accompanying drawings.

Figure 1:
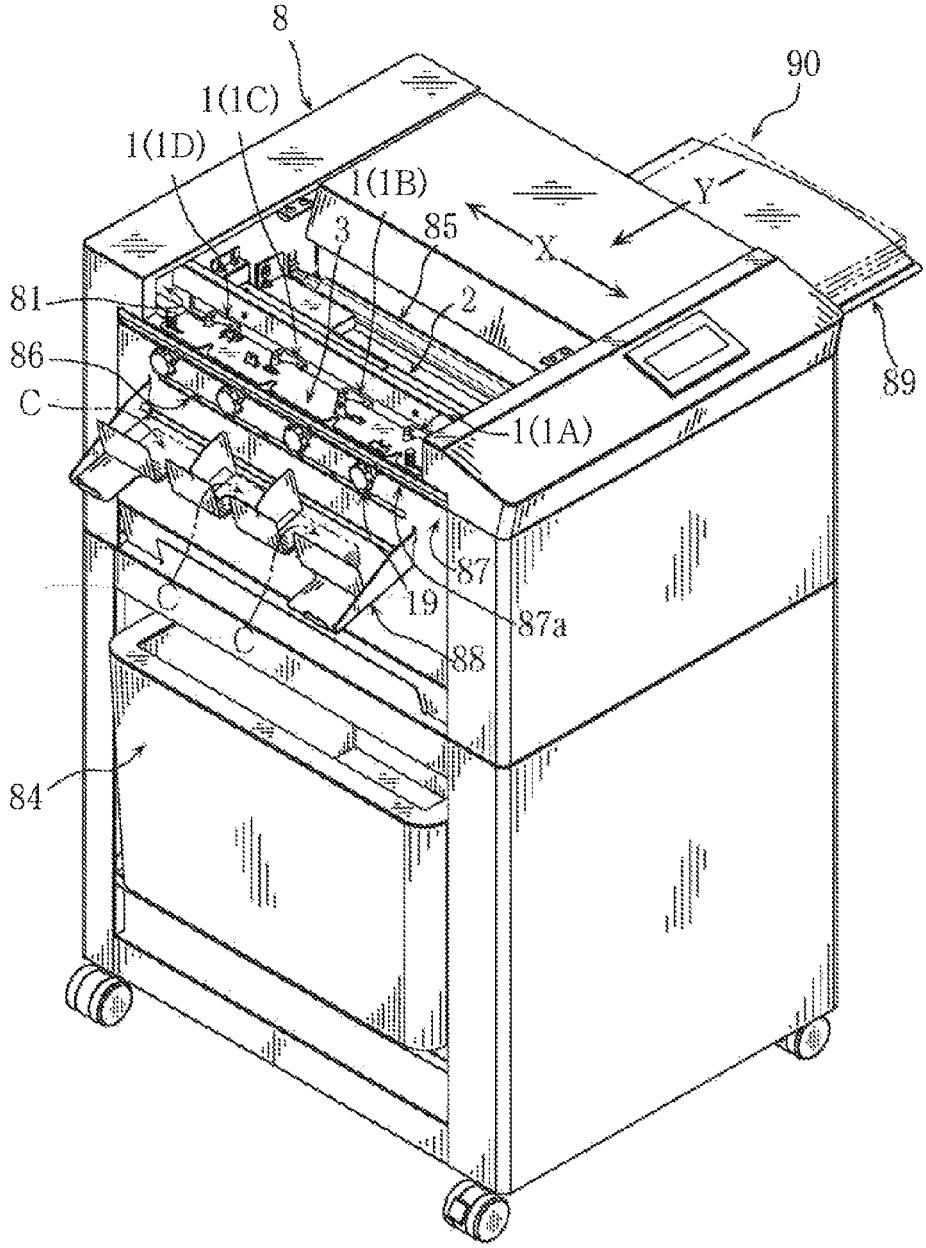
FIG. 1 is a perspective view showing an embodiment of card-cutting apparatus according to the present invention.

A card-cutting apparatus relaxing to the present invention for dividing and cutting a sheet of paper 90 to obtain plural cards C of same dimensions as shown in figure 1, is provided with a feeding table 89 on which sheets of paper 90 shown with two-dot broken lines are layered and placed, plural transfer rollers 85 to contact the lower face of the paper 90 and transfer the paper 90 sheet by sheet, a lateral cutter portion 2 to cut the paper 90 in left and right direction (lateral direction) X at right angles with a transferring direction (longitudinal) direction) Y, plural slitter heads 1 to cut the paper 90 in a transferring direction Y, an outlet table 88 on which cards C, formed by divisional cutting of the paper 90 and shown with two-dot broken lines, are stored, and a main body casing 8 of box including the transfer rollers 85, the slitter heads 1, and the lateral cutter portion 2. In the present invention, an upstream side in the transferring direction or the feeding side is called a rear side, and a downstream side in the transferring direction or the outlet side is called front side.

The outlet table 88 is attached to a front wall 87 of the main body casing 8 through which an outlet 86 is formed, and the feeding table 89 is attached to a rear wall through which a feeding opening is formed. A dust box 84 for storing cut waste portion (cut dust) is stored on a position under the transfer rollers 85 as to be drawn forward.

Figure 2:
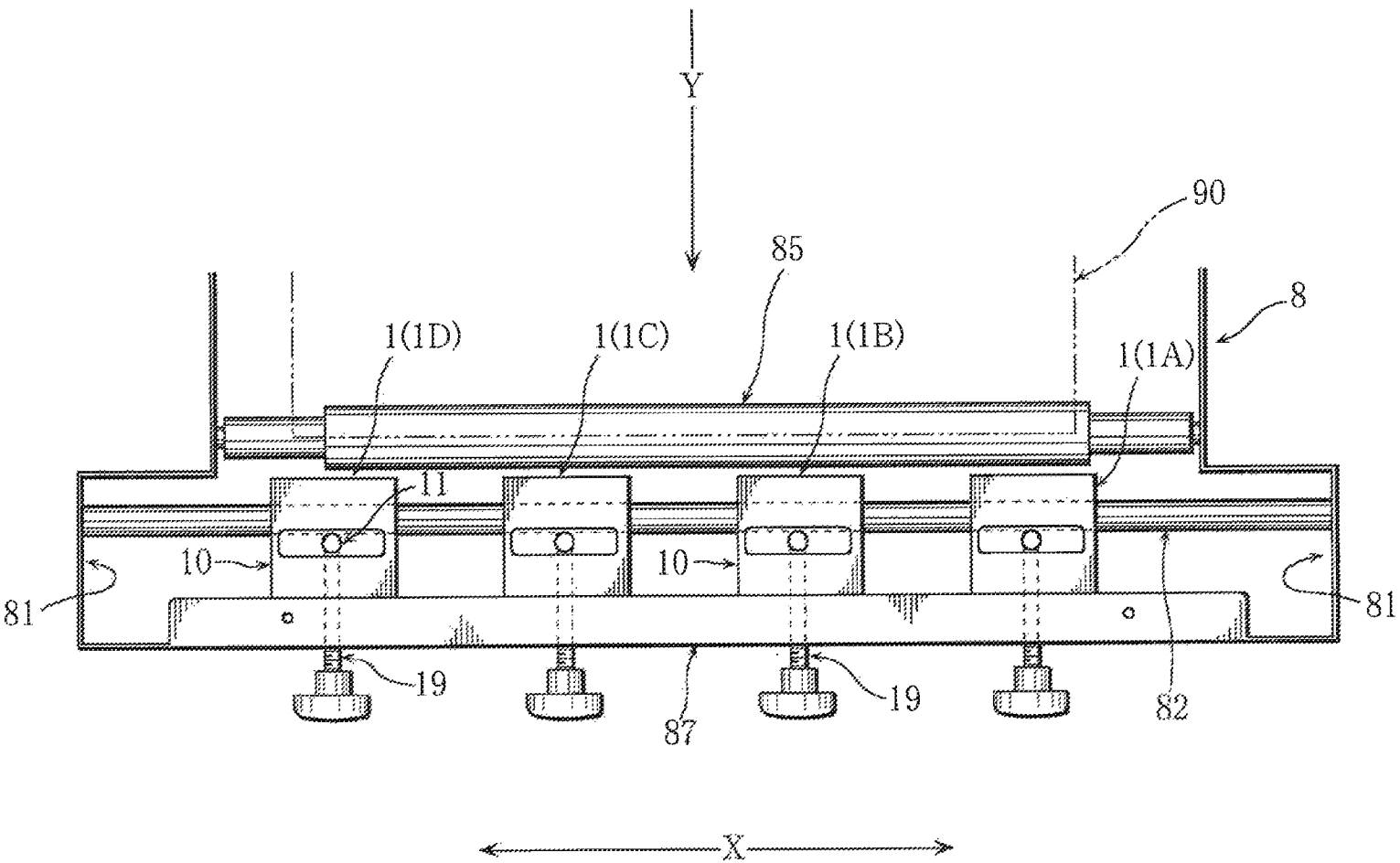
FIG. 2 is a top view of a principal portion.

As shown in FIG. 2, number of the slitter heads 1 is 4, each of head casings 10 is mounted to a guiding rod 82 of round rod fixed to a forward end portion within the main body casing 8 along the lateral direction X and disposed in a row in the lateral direction X. An operation rod 19 is screwed to each of the slitter heads 1. The slitter head 1 is called simply the head 1 in some cases.

The plural heads 1 are end heads 1A and 1D disposed near both end portions of the guiding rod 82, and plural middle heads 1B and 1C between the end heads 1A and 1D.

Among the end heads 1A and 1D, the head disposed on one side is called an end head 1A, and the head disposed on the other side is called the other end head 1D in some cases.

Among the middle heads 1B and 1C, the head neighboring the end head 1A is called a first middle head 1B, and the head neighboring the other end head 1D is called a second middle head 1C in some cases.

As shown in FIG. 1, the plural heads 1 can be position-adjustable along the guiding rod 82 manually and independently (one by one) by moving the operation rod 19, protruding forward through a lateral hole 87*a* formed through the front wall 87 of the main body casing 8 in the lateral direction X.

And, the operation rod 19 is screwed forward to contact and fixed to the guiding rod 82 at right angles within the head 1 by manual rotation of the operation rod 19 around an axis. The fixation is released by screwing backward the operation rod 19 to make the head 1 laterally slidable. That is to say, the head 1 can be freely slid and fixed by manual work.

Further, as shown in FIG. 2, a pair of retreat spaces 81 is formed on positions (areas) on outer sides of the transferred paper 90 and near the end portions of the guiding rod 82 in the main body casing 8. The both end heads 1A and 1D can be respectively disposed in the retreat spaces 81 by sliding laterally outward along the guiding rod 82.

Figure 3:
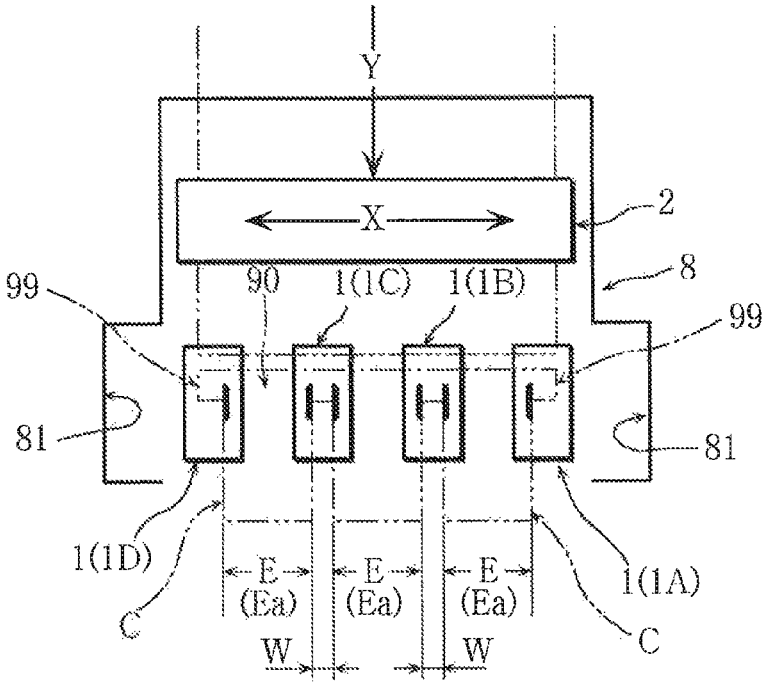
FIG. 3 is a simplified top view showing an example of cutting lay-out of plural slitter heads.

As shown in FIG. 3, in a case that 3 cards C are made of the paper 90 cut by the lateral cutter portion 2, namely, in a case that the 4 heads 1 are used, the heads 1 are not disposed in the retreat spaces 81.

Figure 4:
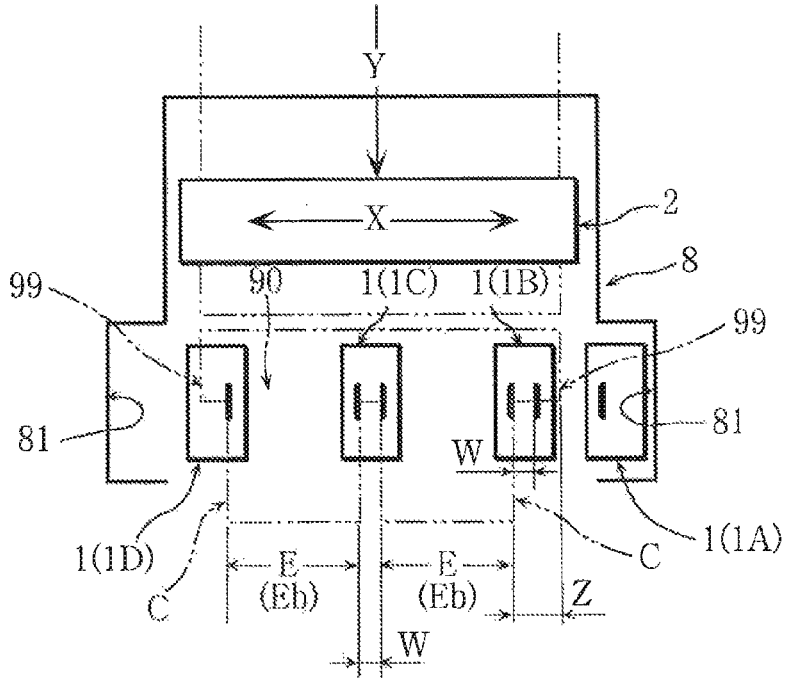
FIG. 4 is a simplified top view showing another example of cutting lay-out of the plural slitter heads.

And, as shown in FIG. 4, in a case that 2 cards C are made of the paper 90 cut by the lateral cutter portion 2, namely, in a case that the 3 heads 1 are used, the unused head 1, concretely, the end head 1A is disposed in one of the retreat spaces 81 to retreat from the transferring way of the paper 90. Although not shown in figures, the other end head 1D may retreat into the other retreat space 81. That is to say, the unused head 1 is moved into the retreat space 81 outside of the transferring way on which the paper 90 is transferred.

Figure 5:
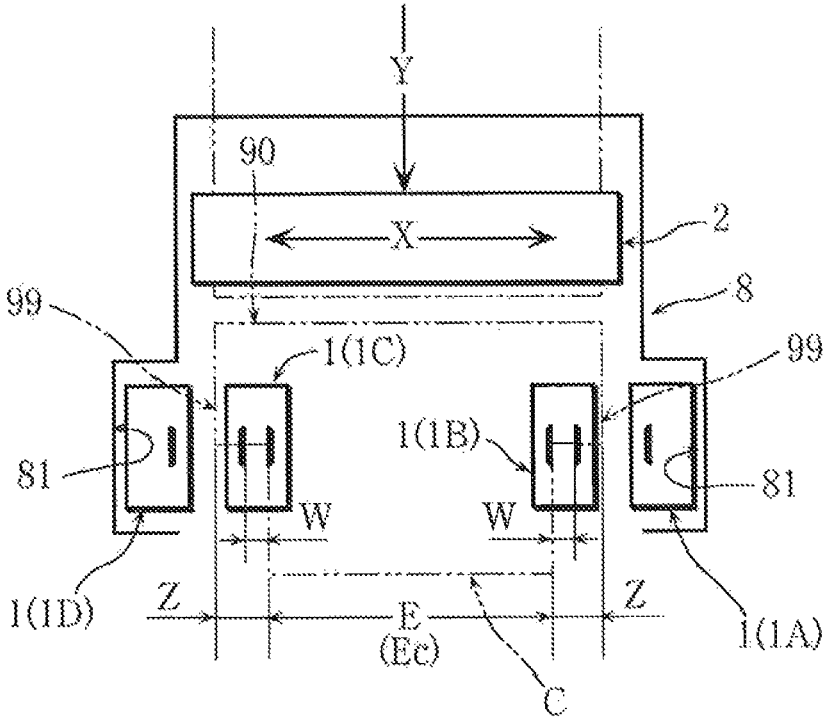
FIG. 5 is a simplified top view showing a further example of cutting lay-out of the plural slitter heads.

And, as shown in FIG. 5, in a case that one card C is made of the paper 90 cut by the lateral cutter portion 2, namely, in a case that the 2 heads 1 are used, the two unused heads 1, concretely, the end heads 1A and 1D retreat respectively in the retreat spaces 81.

Figure 6:
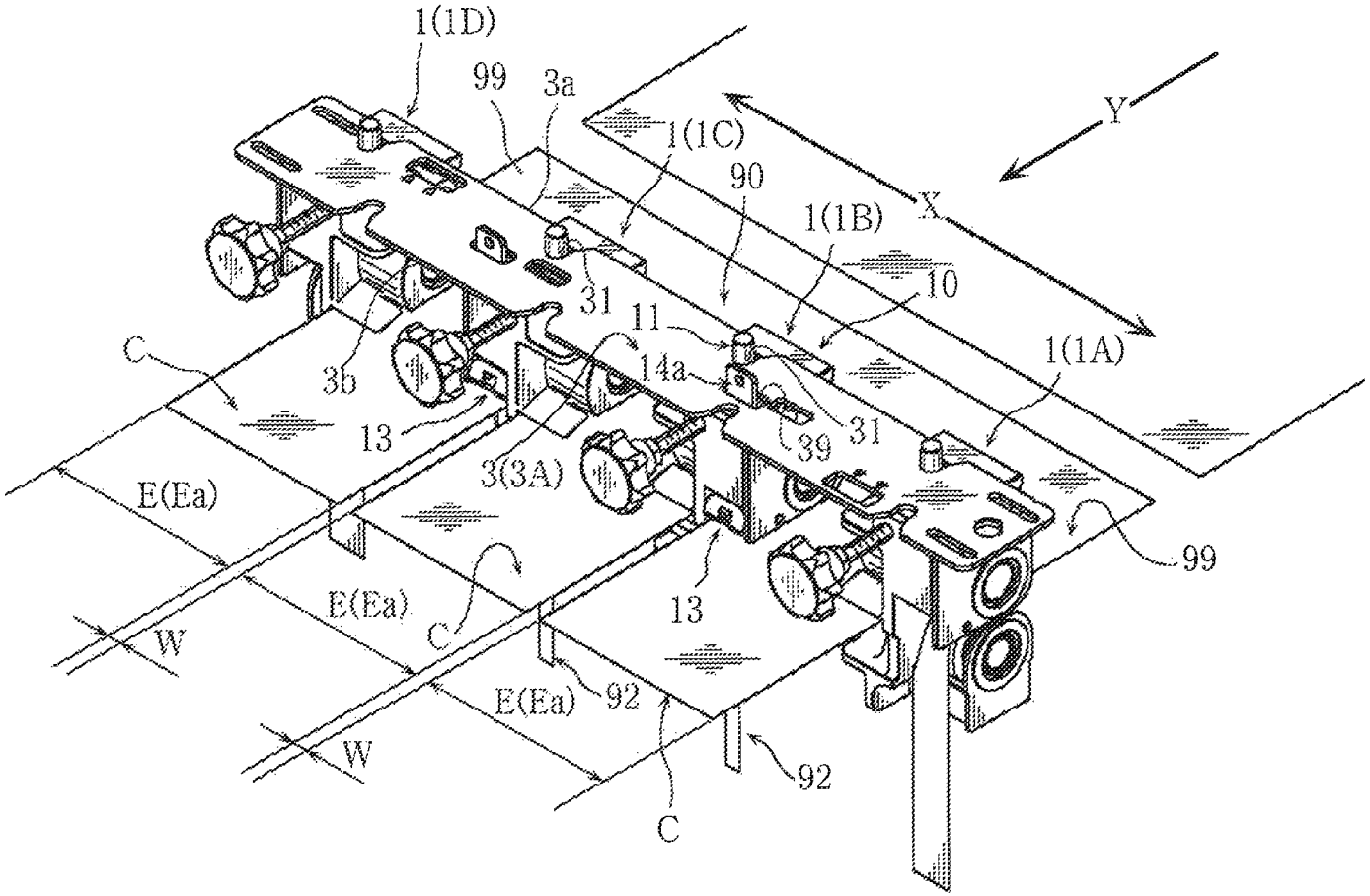
FIG. 6 is a perspective view of a principal portion showing an example of positioning state by a gauge plate.
Figure 7:
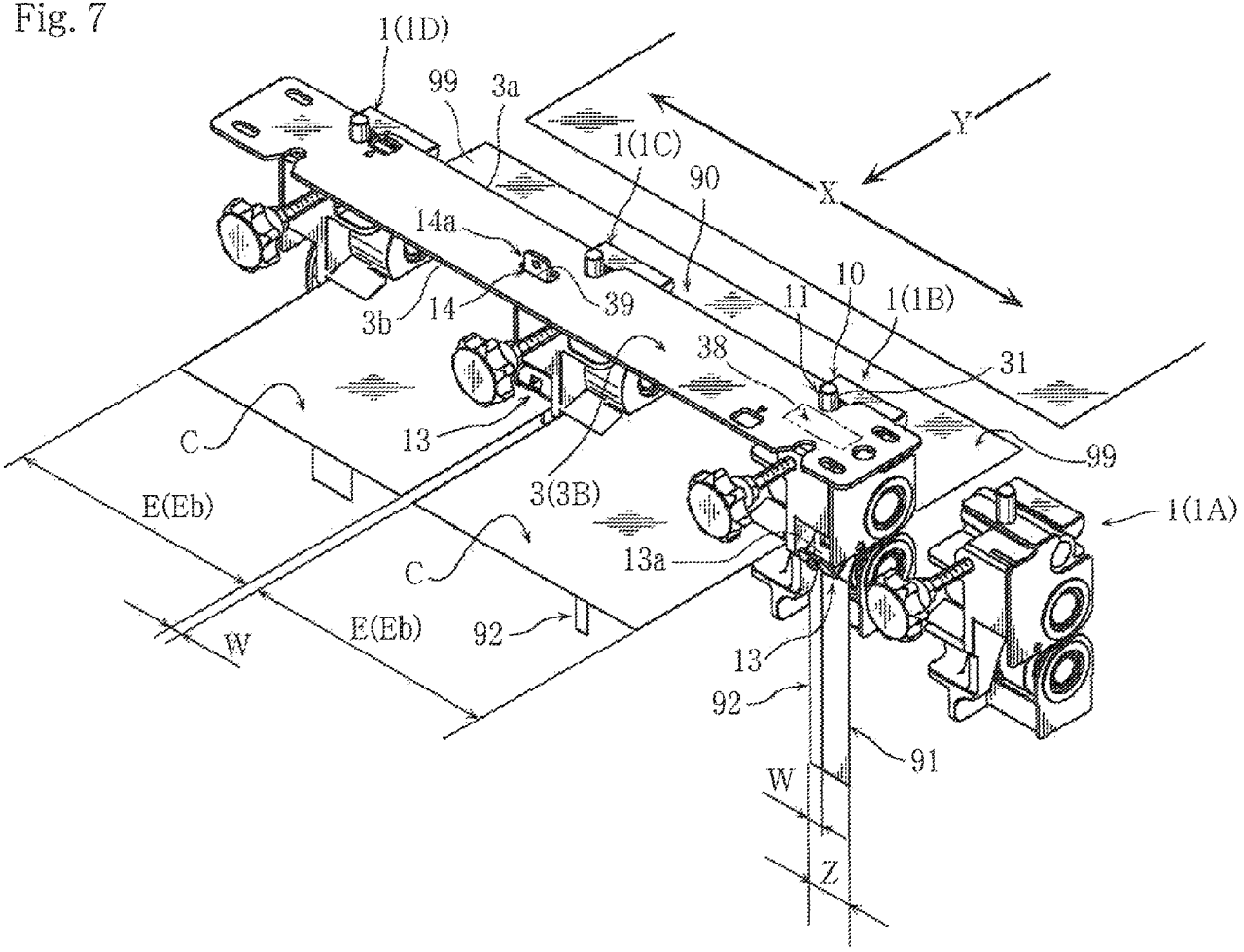
FIG. 7 is a perspective view of a principal portion showing another example of positioning state by the gauge plate.

Further, as shown in FIG. 6 and FIG. 7, a gauge plate 3 is provided for positioning of the plural heads 1, disposed (used) on the transfer way of the paper 90 to cut the paper 90 with a predetermined card cutting dimension E, on predetermined positions in the lateral direction X. The gauge plate 3 is called a gauge 3 in some cases.

As shown in FIG. 6 through FIG. 9, the gauge 3 is a laterally long belt plate in which plural notched portions 31, for positioning to which pin portions 11 protruding upward from the upper face of the head casing 10 are inserted, are formed with predetermined interval dimensions.

The predetermined interval dimension means a dimension with which the pin portions 11 are inserted to the notched portions 31, and the card C having the predetermined card cutting lateral dimension E is made by the heads 1 neighboring in the lateral direction X. The both cases that the plural notched portions 31 are disposed with uniform intervals and ununiform intervals are included.

Figure 8:
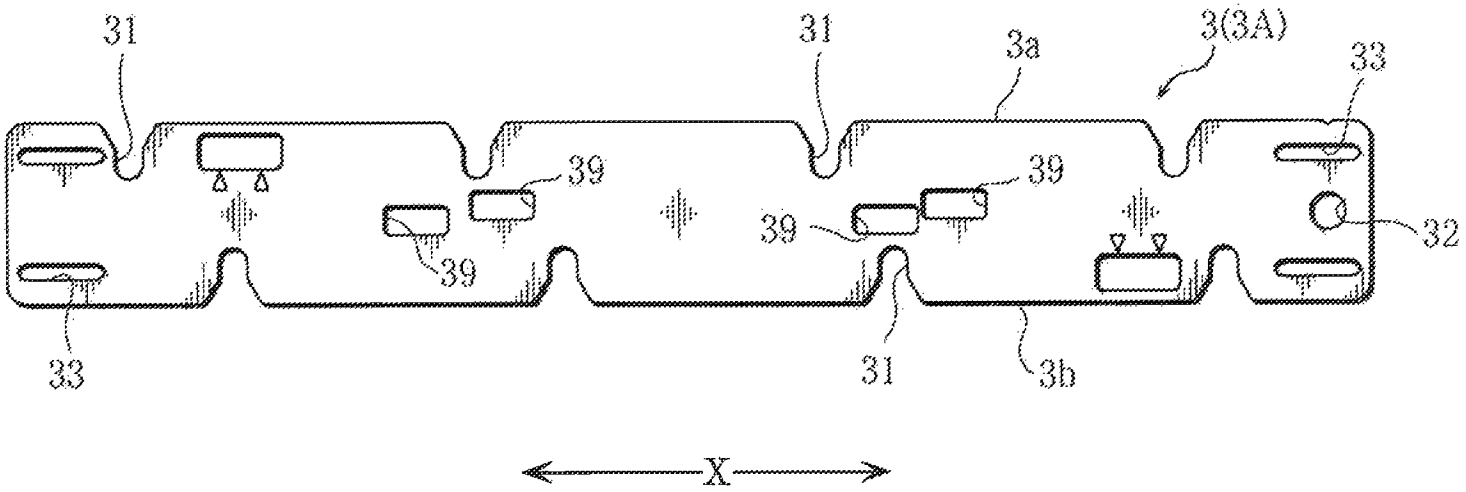
FIG. 8 is a top view showing a first gauge plate.

Plural kinds of the gauge 3 of different card cutting lateral dimensions E, namely, different positioning dimensions are provided. For example, a first gauge 3A to position the 4 heads 1 to cut the paper 90 with a first card cutting lateral dimension Ea as shown in FIG. 6 and FIG. 8, and a second gauge 3B to position the 3 heads 1 to cut the paper 90 with a second card cutting Lateral dimension Eb, are provided.

That, is to say, the plural gauges 3A and 3B of different card cutting lateral dimensions E are provided, and one of the plural gauges 3A and 3B is selected and used.

Further, the gauge 3 has a first notched row (group) composed of the plural notched portion 31 notched on a side edge 3*a* and a second notched row (group) composed of the plural notched portion 31 notched on another side edge 3*b*. The above-described predetermined interval dimension (positions or number in the lateral direction X) is different in the first notched row and the second notched row.

For example, as shown in FIG. 4 and FIG. 7, the positioning is conducted on the first notched row on the side edge 3*a* of the second gauge 3B in case that the positioning is conducted to cut with the second card cutting lateral dimension Eb to make 2 cards C of the paper 90, cut by the lateral cutter portion 2, by the three heads 1.

And, as shown in FIG. 5, although gauge attachment state is not shown in figures, the positioning is conducted on the second notched row on the other side edge 3*b* of the second gauge 3B in case that the positioning is conducted to cut with the third card cutting lateral dimension Ec to make one card C of the paper 90, cut by the lateral cutter portion 2, by the two heads 1.

And, as shown in FIG. 3 and FIG. 6, the positioning is conducted on the first notched row on the side edge 3*a* of the first gauge 3A in case that the positioning is conducted to cut with the first card cutting lateral dimension Ea to make three cards C of the paper 90, cut by the lateral cutter portion 2, by the four heads 1.

And, although not shown in figures, the positioning is conducted on the second notched row on the other side edge 3*b* of the first gauge 3A in case that the positioning is conducted to cut with a dimension smaller than the first card cutting lateral dimension Ea by the four beads 1.

That is to say, the positioning is possible to cut the paper 90 with different card cutting lateral dimensions E by the selection of the side edge 3*a* and the other side edge 3*b* of the gauge 3 to correspond to the slitter heads 1. In other words, one of the first notched row and the second notched row of the gauge 3 is selected and used. In further different expression, one of front and rear directions or obverse and reverse sides of the gauge 3 is selected and used.

And, a standard hole 32 to which a gauge positioning pin fixed to the main body casing 8 is formed on an end portion of the gauge 3. And, an attachment lateral hole 33 is formed near corner portions for attachment to the main body casing 8.

Figure 10:
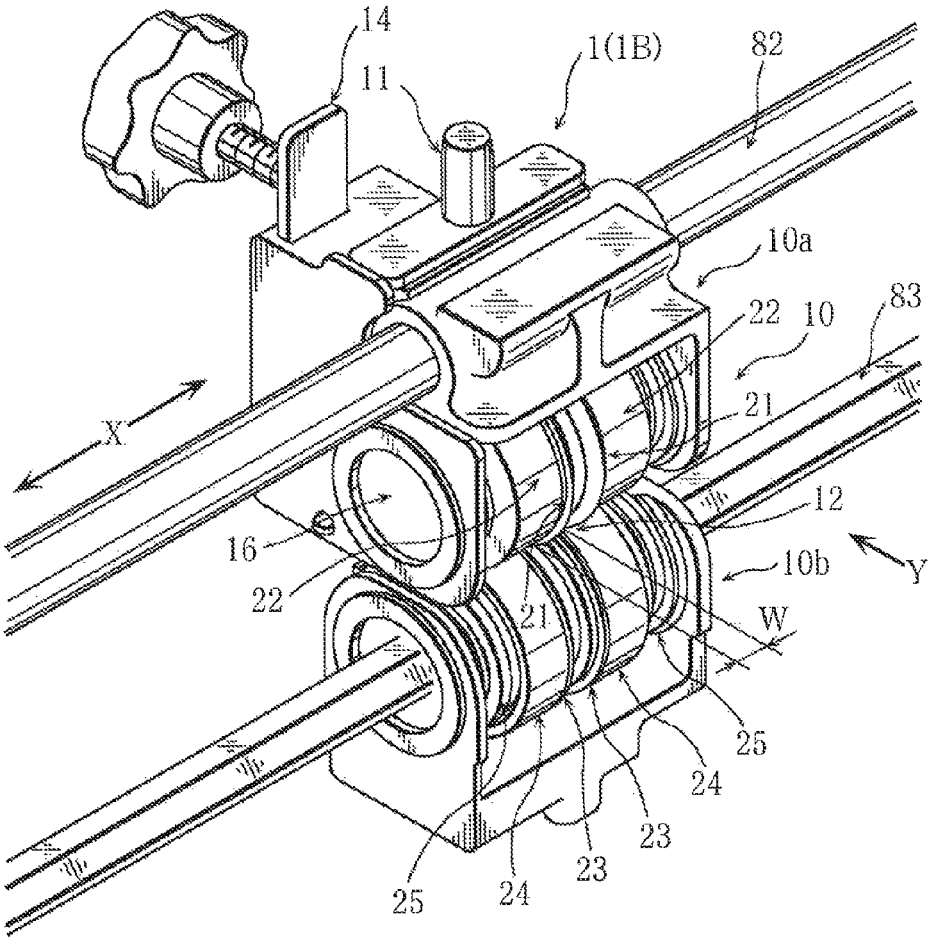
FIG. 10 is a perspective view showing an example of the slitter head.

Next, as the first middle head 1B shown in FIG. 10, in the middle heads 1B and 1C, the guiding rod 82 is inserted to an upper portion 10*a* of the head casing 10, and a driving shaft 83 of hexagonal rod is inserted to a lower portion 10*b*.

The driving shaft 83 is beamed along the lateral direction on a position under the transferred paper 90 and electrically driven and controlled to rotate. The head casing 10 is freely slidable along the guiding rod 82 and the driving shaft 83 in the lateral direction.

Figure 11:
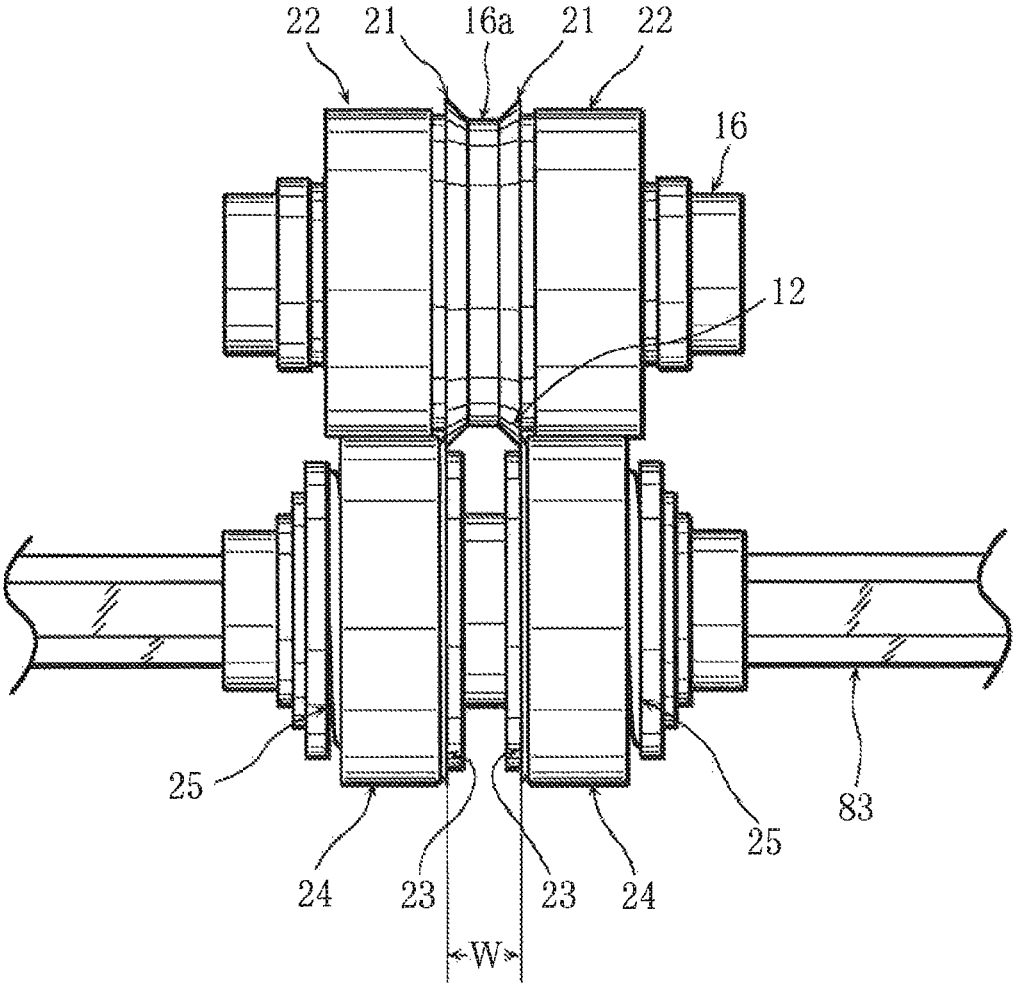
FIG. 11 is an enlarged front view of a principal portion showing an example of a cutter portion.

As shown in FIG. 10 and FIG. 11, the upper portion 10*a* of the head casing 10 has a short shaft 16, a pair of upper blades 21 mounted to the short shaft 16 as to freely rotate, and a pair of following rollers 22 mounted to the short shaft 18 and disposed on the both sides of the pair of upper blades 21.

The lower portion 10*b* of the head casing 10 has a short shaft 16, a pair of lower blades 23 mounted to the driving shaft 83 as to freely slide in the lateral direction X and be driven to rotate around the axis of the driving shaft 83, and a pair of driving rollers 24 mounted to the driving shaft 83 as to freely slide in the lateral direction X, be disposed on the both sides of the pair of lower blades 23, and give rotational force to the following rollers 22.

The upper blade 21 and the lower blade 23 are single-edged type formed into an edged blade of trapezoidal configuration (low truncated cone) in front view.

The pair of upper blades 21 is made contact a middle brim portion 16*a* of the short shaft 16 on both sides to cut the paper 90 into longitudinal strips with a predetermined cutting lateral width dimension W.

The lower blades 23 are disposed on outer sides of the pair of upper blades 21, and pressed by a pair of elastic pushing members 25 composed of spiral springs to make a peripheral edge portion of the lower blade 23 contact a peripheral edge portion of the upper blade 21. The upper blade 21 is rotated by frictional force of the pushed contact portion.

The middle heads 1B and 1C cut waste portions of the paper 90, going between the driving rollers 24 and the following rollers 22, with the predetermined cutting lateral width dimension W by a cutter portion 12 composed of the pair of upper blades 21 and the pair of lower blades 23 (refer to FIG. 6). In other words, the middle heads 1B and 1C are constructed to form 2 cutting edges to cut out a slit. The portion cut by the cutter portion 12 of the middle heads 1B and 1C is called a longitudinal waste portion 92.

Figure 12:
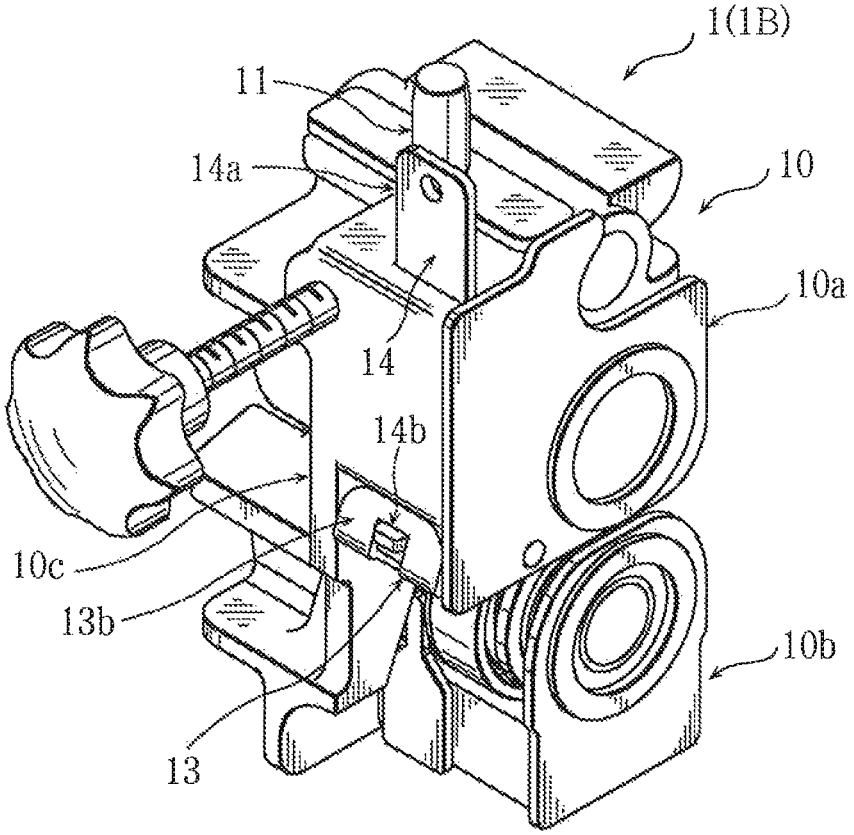
FIG. 12 is a perspective view showing a slitter head in which a guiding member is in a non-guiding posture.
Figure 13:
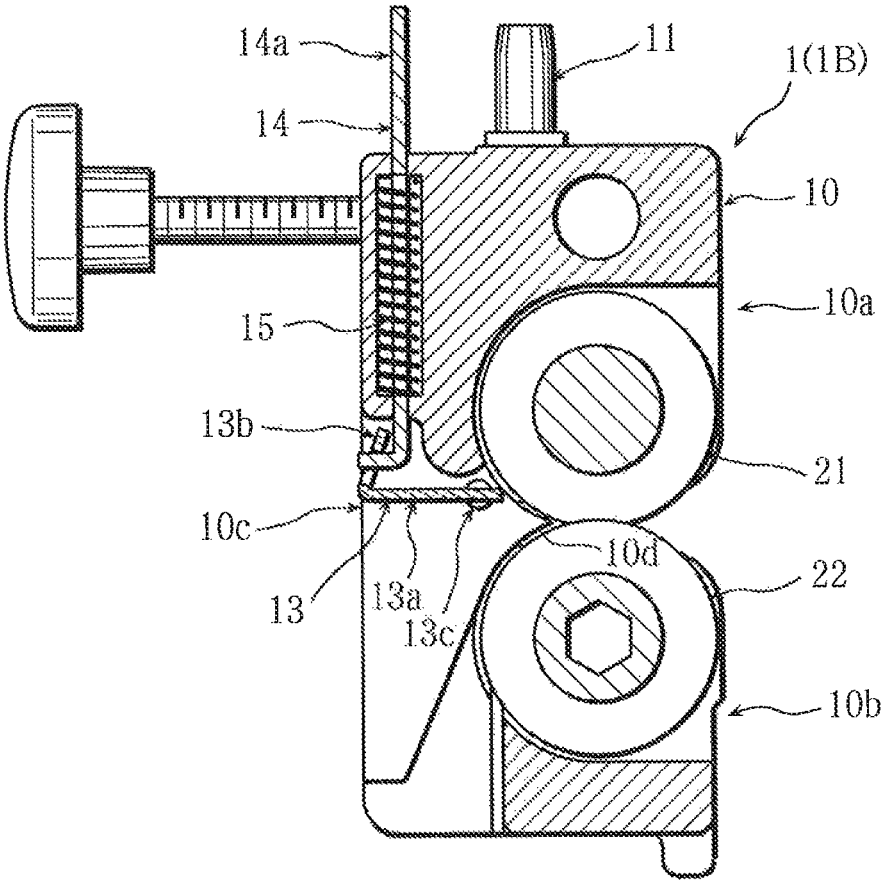
FIG. 13 is a cross-sectional side view of the slitter head.

In the middle heads 1B and 1C, as the first middle head 1B shown in FIG. 12 and FIG. 13, the head casing 10 has a connecting portion 10*c* to connect the upper portion 10*a* and the lower portion 10*b*, and these are formed into one block as a whole. The connecting portion 10*c* is disposed on a position between the lower blades 23 in the lateral direction X, and on a position in front of the cutting portion by the cutter portion 12 in the transferring direction Y.

Further, a guiding face 10*d* inclined forward and downward is formed on a rear face side of the connecting portion 10*c*.

That is to say, the paper 90 transferred to the connecting portion 10*c* is made into the longitudinal waste portion 92 by the cutter portion 12, oscillated downward along the guiding face 10*d*, and cut down.

Each of the end heads 1A and 1D, although not shown in figures, has an upper blade and a lower blade to cut side edge portions 99 of the paper 90 straightly along the transferring direction Y with one cutting edge. And, each of the end heads 1A and 1D has a guiding sloped face inclined forward and downward to guide the side waste portions, formed by cutting on the outer sides, downward (refer to FIG. 6). Similar to the middle heads 1B and 1C, the guiding rod 82 and the driving shaft 83 are inserted to the head casing 10 to be slid in the lateral direction X and fixed.

Further, the middle heads 1B and 1C, as the first middle head 1B shown in FIG. 7, are disposed on positions corresponding to the side edge portions 99 of the paper 90 and provided with a guiding member 13 to guide side edge waste portions 91, on positions outer than the longitudinal waste portions 92, suspended downward when the side waste portions, having a lateral waste dimension Z wider than the cutting lateral dimension W, are cut.

Figure 14:
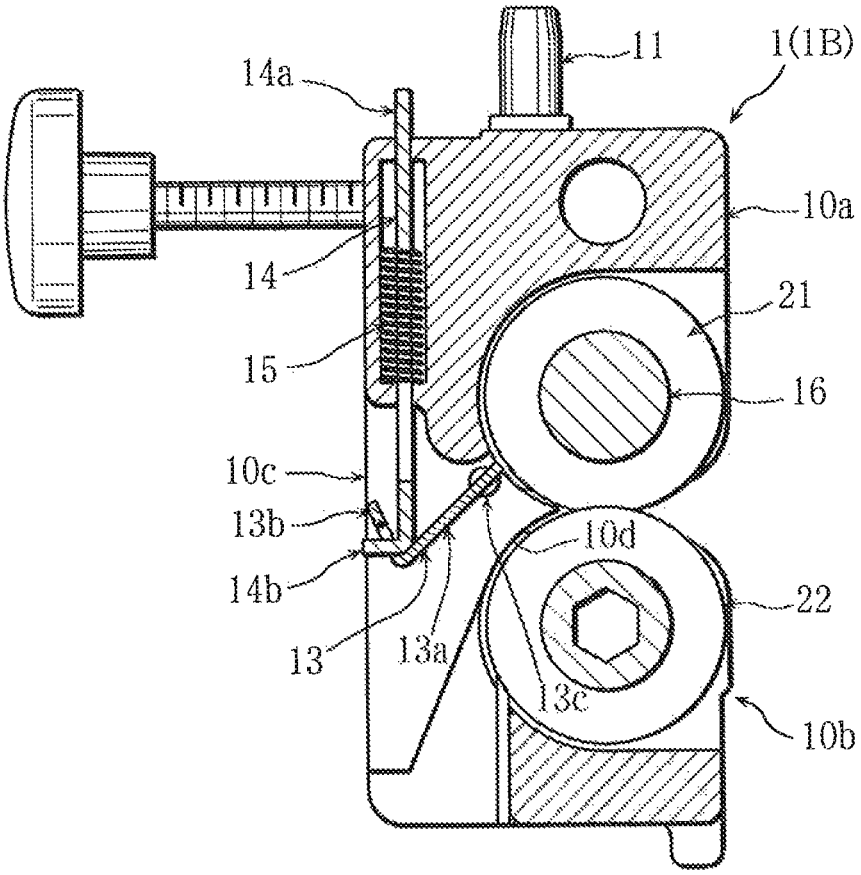
FIG. 14 is a cross-sectional side view showing a slitter head in which the guiding member is in a guiding posture.

As shown in FIG. 12 through FIG. 14, the guiding member 13 is disposed in front of the cutting portion by the upper blade 21 and the lower blade 23, and on the outer side of the guiding face 10*d*. In the first middle head 1B, the guiding member 13 is disposed on one side of the guiding face 10*d*. And, in the second middle head 1C, the guiding member 13 is disposed on another side of the guiding face 10*d*.

And, the guiding member 13, L-shaped in side view, has a pair of horizontal shaft portions 13*c* supported by the head casing 10, a guiding plate portion 10*a* in which the shaft portions 13*c* are disposed on a rear end portion, and a connecting piece portion 10*b* bent on a front end portion of the guiding plate portion 10*a*.

In FIG. 13 and FIG. 14, the following roller 22, the driving roller 24, and the elastic pushing member 25 for pressing the blades, are omitted.

The guiding member 13 is in non-guiding posture escaped over the paper 90 in an upper oscillation state in which the guiding plate portion 13*a* is horizontal (refer to FIG. 13), and in guiding posture to guide the side wedge waste portion 91 of the transferred paper 90 downward in a lower oscillation state in which the guiding plate portion 13*a* is inclines forward and downward (refer to FIG. 14).

Further, a guide operation member 14, of which lower end portion 14*b* is connected to the connecting piece portion 13*b* of the guiding member 13, disposed on the head casing 10 as to freely slide in vertical directions, is provided.

The guide operation member 14 is always elastically pushed upward by an elastic pushing member 15 composed of a spiral spring disposed and held within the head casing 10, and the front end side of the guiding plate portion 13*a* of the guiding member 13 is raised upward and held on an upper position.

An upper end portion 14*a* of the guide operation member 14 is disposed to protrude upward from the upper face of the head casing 10.

The guiding member 13 is kept in the non-guiding posture of the upper oscillation state by the guide operation member 14 on the upper position. When the upper end portion 14*a* of the guide operation member 14 is made on a lower position with resistance to the elastic force of the elastic pushing member 15, the guiding plate portion 13*a* is oscillated downward to switch the guiding member 13 in the non-guiding posture to the guiding posture.

And, as shown in FIG. 7, the second gauge 3B has a pressing portion 38 (an area surrounded by a two-dot broken line in FIG. 7) to press upper end portion 14*a* of the guide operation member 14 of the first middle head 1B and an escape hole portion (escape space) 39 to which the upper end portion 14*a* of the guide operation member 14 of the second middle head 1C in case that the end head 1A retreats from the transfer way of the paper 90 on one side, the first middle head 1B is disposed on a position corresponding to one of the side edge portions 99 of the paper 90, the second middle head 1C is disposed on a position corresponding to the middle portion of the paper 90, and the other end head 1D is disposed on a position corresponding to the other of the side edge portions 99 of the paper 90 to conduct the cutting.

That is to say, the middle head 1 (the first middle head 1B in FIG. 7) disposed on the position corresponding to one of the side edge portions 99 of the paper 90 guides the longitudinal waste portion 92 downward with the above-described guiding face 10*d* and the side edge waste portion 91 downward with the guiding member 13, and let them fall into the dust box 84.

And, the middle head 1 (the second middle head 1C in FIG. 7) disposed on the position corresponding to the middle portion of the paper 90 cuts the paper 90 with the predetermined cutting lateral width dimension W into a slit, and guides the longitudinal waste portion 92 downward with the above-described guiding face 10*d*. And, the guiding member 13 in non-oscillated posture does not guide the portion to be the card C downward.

Figure 15:
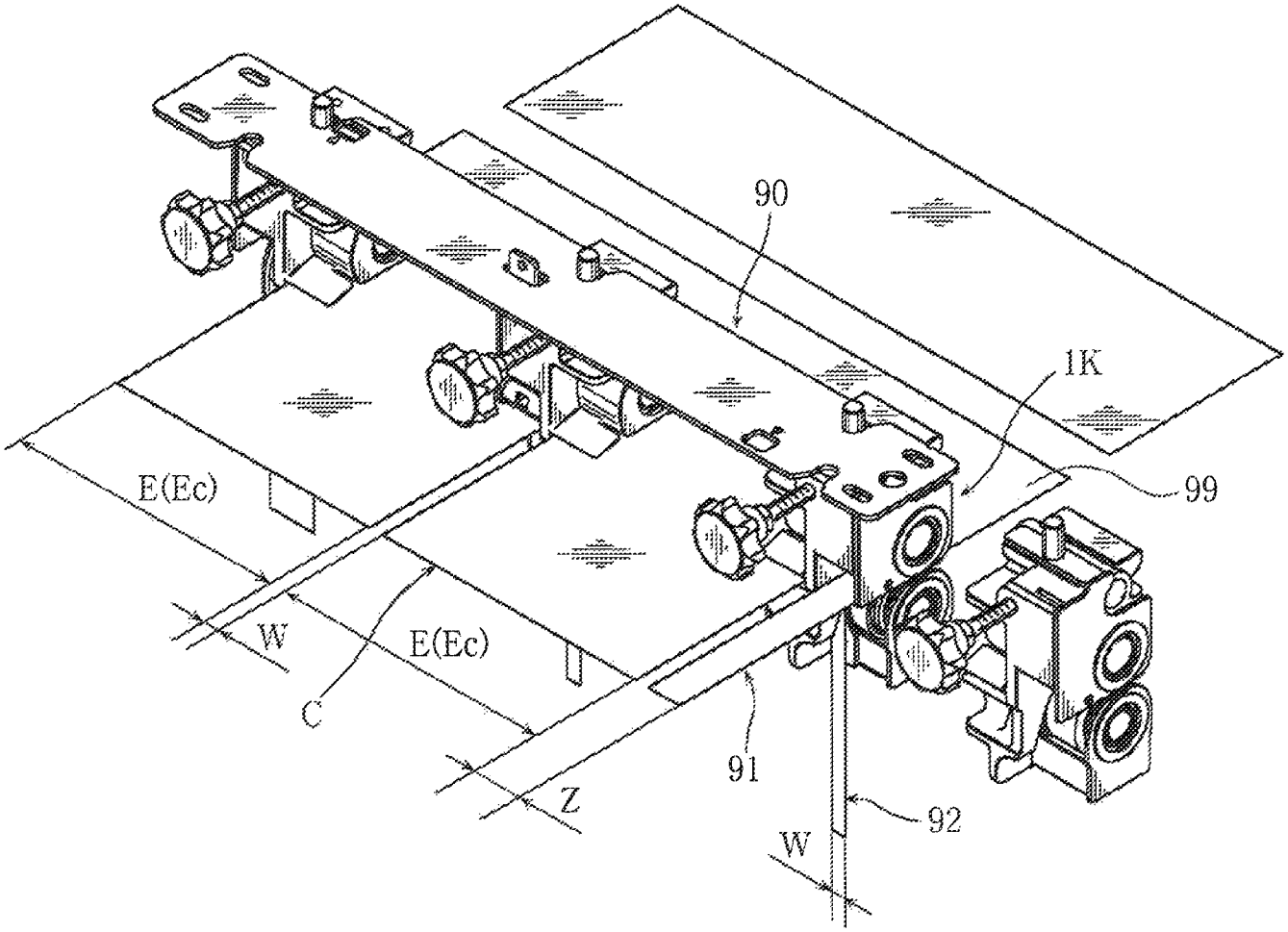
FIG. 15 is a perspective view to explain an error.

For example, as shown in FIG. 15, when cutting is conducted with a middle head 1K of a comparison example without the guiding member 13 and disposed on a position corresponding to one of the side edge portions 99 of the paper 90, although the Longitudinal waste portion 92 is guided downward by the guiding face 10*d*, there is a problem that the side edge waste portion 91 on the outer side of the longitudinal waste portion 92 does not become suspended by self weight for strength (rigidity) of the paper 90, not fall into the dust box 84, and an error that the side edge waste portion 91 is sent out of the outlet 86 with the card C to be made is generated. That is to say, this problem is solved by the guiding member 13.

Figure 9:
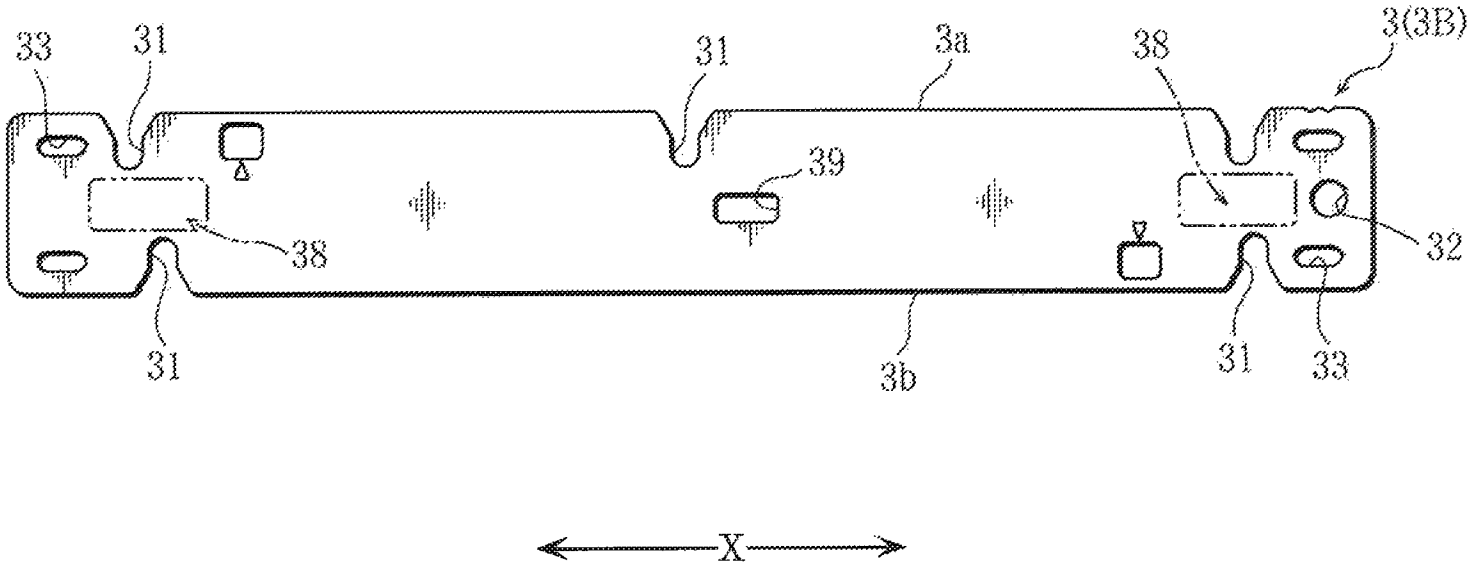
FIG. 9 is a top view showing a second gauge plate.

And, the second gauge 3B shown in FIG. 9 has a pressing portion 38 to press the guide operation member 14 of the first middle head 1B and a pressing portion 38 to press the guide operation member 14 of the second middle head 1C as to correspond to the second notched row in case that both side waste portions respectively having the lateral waste dimension Z wider than the cutting lateral width dimension W are respectively cut by the two middle heads 1B and 1C (refer to FIG. 5), namely, in case that the positioning is conducted with the side edge 3*b* side of the second gauge 3B.

And, the first gauge 3A shown in FIG. 6 and FIG. 8 has escape hole portions 39 to each of which the upper end portion 14*a* of the guide operation member 14 of the middle heads 1B and 1C disposed on the middle position of the paper 90 as to correspond to the first notched row in case that the end heads 1A and 1B are respectively corresponding to the side edge portions 99 of the paper 90, and the middle portion of the paper 90 is cut by both of the middle heads 1B and 1C, namely, in case that the positioning is conducted with the side edge 3*a* side of the first gauge 3A.

And, the first, gauge 3A has escape hole portions 39 to each of which the upper end portion 14*a* of the guide operation member 14 of the middle heads 1B and 1C, disposed on the middle position of the paper 90, is inserted as to correspond to the second notched row in case that the positioning is conducted with the side edge 3*b* side of the first gauge 3A.

And, the user standing near the front wall 87 of the main body casing 8 can easily operate the heads 1 because the lateral cutter portion 2 is disposed on an upstream side and the heads 1 are disposed on a downstream side within the main body casing 8. And, although transfer delay and positional deviation may be caused when the paper 90 is cut by the heads 1 before the lateral cutter portion 2, and the cut paper 90 is flexed between the transfer rollers 85 and transferred with waved shape, the transfer is conducted certainly and smoothly because the paper 90 is cut by the lateral cutter portion 2 first, and the card C can be made with good accuracy.

In the present invention, being modifiable, 5 or more heads 1 may be provided. That is to say, 3 or more middle heads 3 may be provided. And, although one head 1 can retreat to each of the retreat spaces 81 on the both sides in figures, two heads 1, namely, the middle heads 1 may retreat. And, the lateral cutter portion 2 may be disposed on a downstream side to the heads 1. And, the lateral cutter portion 2 may be freely arranged such as that an upper cutting blade and a lower cutting blade of metal strip are pivoted like scissors to cut the paper 90 by oscillation in vertical direction, and a guillotine type in which edges of an upper cutting blade and a lower cutting blade horizontally come close and part from each other. And, the lateral cutter portion 2 may cut the paper 90 into lateral strips having front-rear width dimension, and cut the paper 90 on one lateral straight line. Not being restricted to the examples shown in figures, 3 or more kinds of the gauge plate 3 may be provided. And, the gauge plate 3 may not be provided with the pressing portion 38 and the escape hole portion 39, and an operation plate having the pressing portion 38 and the escape hole portion 39 may be provided. And, the sizes of the card C to be made are various such as post cards, photographs, desktop calendar sheets, business cards. The size of the paper 90 is random. And, the direction of the thickness of the paper 90 is called vertical direction in the present invention. The guiding rod 82 and the driving shaft 83 are omitted in FIG. 3 through 7 and FIG. 15.

As described above, the apparatus can be small and light-weight as a whole and produced with low cost because in the card-cutting apparatus of the present invention, provided with the lateral cutter portion 2 to cut the paper 90 in the lateral direction X at right angles with the transferring direction Y and the plural slitter heads 1 to cut the paper 90 in the transferring direction X, to conduct divisional cutting of the paper 90 into plural cards C, the plural slitter heads 1 are disposed in a row along the guiding rod 82 set in the lateral direction X as to be freely position-adjusted in lateral direction by manual work, the gauge plate 3, for positioning of the plural slitter heads 1 on predetermined positions in the lateral direction X as to cut the paper 90 with the predetermined card cutting lateral dimension E, is provided, and, the gauge plate 3 is selected from plural kinds having different card cutting lateral dimensions E to be used. The longitudinal dimension can be shorter than that of a case in which the slitter heads 1 are disposed in two rows. The slitter head 1 can be easily and swiftly positioned to correspond to the size (the card cutting lateral dimension E) of the card C to be made. The slitter head 1 is prevented from being disposed on a wrong position, and accurate disposition is possible. High skill of positioning is unnecessary, and cards of good quality having stable lateral dimension can be obtained. The positioning can be conducted with accuracy in comparison with positioning by eyesight.

And, the plural slitter heads 1 can be easily and swiftly positioned because the pin portion 11 protruding upward is disposed on the slitter head 1, the plural notched portions 31 for positioning, to which the pin portion 11 is inserted, are formed on the gauge plate 3 with predetermined interval dimensions, and the plural slitter heads 1 are positioned by the gauge plate 3 selected from the plural kinds. The gauge plate 3 can be easily moved in the longitudinal direction Y close to the pin portions 11 to be easily fit.

And, it is unnecessary to detach the unused slitter head 1 from the guiding rod 82, and the position adjustment of the slitter heads 1 can be easily and swiftly conducted to correspond to the size of the card C to be made because the slitter head 1 is moved along the guiding rod 82 to the retreat space 81 on outer sides of the transfer way on which the paper 90 is transferred as to make the unused slitter head 1 retreative.

For example, preparation (plan) of card making can be easily and swiftly conducted, and the number of the heads 1 can be reduced to be made easily and economically in comparison with a case that a head unit provided with plural heads 1 fixed to predetermined positions with predetermined card cutting lateral dimension E is made, plural kinds of the head unit having different card cutting lateral dimensions E are prepared, and one of the head units is selected and used to correspond to the size of the card C to be made.

And, when the side waste portion having the lateral waste dimension Z wider than the cutting lateral dimension W is removed, the side edge waste portion 91 on the outer side of the longitudinal waste portion 92 is certainly guided downward, not let be extracted from the outlet 86, and made fall into the dust box 84 below because the slitter head 1 is provided with the cutter portion 12 to cut the waste portion of the paper into the longitudinal strip with the predetermined cutting lateral width dimension W, the guiding member 13 freely oscillatable up and down to guide the side edge waste portions 91, on positions outer than the longitudinal waste portions 92 formed by the cutter portion 12, downward in the lower oscillation state, the guide operation member 14 vertically slidable to make the lower oscillation state of the guiding member 13 on the lower position, and an elastic pushing member 15 always elastically pushing the guide operation member 14 to an upper position to keep the guiding member 13 in the non-guiding posture of the upper oscillation state. When the middle portion of the paper 90 is cut, cutting is smoothly conducted while the guiding member 13 does not block the transfer of the portion to be the card.

And, the user does not need to carefully operate the guide operation member 14, and the guiding member 13 can be easily and swiftly switched to the guiding posture and to the non-guiding posture only by setting the gauge plate 3 because the gauge plate 3 has the pressing portion 38 resisting elastic force of the elastic pushing member 15 and pressing the guide operation member 14 to the lower position to make the lower oscillation state of the guiding member 13.

While preferred embodiments of the present invention have been described in this specification, it is to be understood that the invention is illustrative and not restrictive, because various changes are possible within the spirit and indispensable features.

What is claimed is:

1. A card-cutting apparatus, comprising:

a lateral cutter portion to cut paper in a lateral direction at right angles with a transferring direction;

plural slitter heads to cut the paper in the transferring direction, to conduct divisional cutting of the paper into plural cards, wherein the plural slitter heads are disposed in a row along a guiding rod set in the lateral direction as to be freely and manually position-adjusted in a lateral direction;

a gauge plate for positioning of the plural slitter heads on predetermined positions in the lateral direction as to cut the paper with a predetermined card cutting lateral dimension, is provided;

wherein the gauge plate is selected from plural kinds having different card cutting lateral dimensions to be used; and a pin portion protruding upward is disposed on the slitter head, wherein plural notched portions for positioning, to which the pin portion is inserted, are formed on the gauge plate with predetermined interval dimensions, and wherein the plural slitter heads are positioned by the gauge plate.

2. A card-cutting apparatus comprising:

a lateral cutter portion to cut paper in a lateral direction at right angles with a transferring direction;

plural slitter heads to cut the paper in the transferring direction, to conduct divisional cutting of the paper into plural cards, wherein the plural slitter heads are disposed in a row along a guiding rod set in the lateral direction as to be freely and manually position-adjusted in a lateral direction;

a gauge plate for positioning of the plural slitter heads on predetermined positions in the lateral direction as to cut the paper with a predetermined card cutting lateral dimension, is provided;

wherein the gauge plate is selected from plural kinds having different card cutting lateral dimensions to be used; and the slitter head is comprised of:

a cutter portion to cut a waste portion of the paper into a longitudinal strip with a predetermined cutting lateral width dimension, a guiding member freely oscillatable up and down to guide side edge waste portions, on positions outer than longitudinal waste portions formed by the cutter portion, downward in a lower oscillation state, a guide operation member vertically slidable to make the lower oscillation state of the guiding member on a lower position, and an elastic pushing member elastically pushing the guide operation member to an upper position to keep the guiding member in a non-guiding posture of an upper oscillation state.

3. The card-cutting apparatus as set forth in claim 2, wherein the gauge plate has a pressing portion for resisting elastic force of the elastic pushing member and for pressing the guide operation member to the lower position to make the lower oscillation state of the guiding member.

* * * * *